US006022378A

United States Patent [19]

Eibl

[11] Patent Number: 6,022,378

[45] Date of Patent: Feb. 8, 2000

[54] PROCESS FOR THE TREATMENT OF CELLULOSE FIBRES AND OF ASSEMBLIES MADE FROM THESE FIBRES

[75] Inventor: Markus Eibl, Utzenlaa, Austria

[73] Assignee: Lenzing Aktiengesellschaft, Lenzing, Austria

[21] Appl. No.: 09/212,104

[22] Filed: Dec. 15, 1998

Related U.S. Application Data

[63] Continuation of application No. PCT/AT97/00132, Jun. 19, 1997.

[30] Foreign Application Priority Data

Jun. 21, 1996 [AT] Austria ..... 1107/96

[51] Int. Cl.[7] ..... D06M 13/322

[52] U.S. Cl. ..... 8/190; 8/566

[58] Field of Search ..... 8/190, 566

[56] References Cited

U.S. PATENT DOCUMENTS

| | | | |
|---|---|---|---|
| 3,278,253 | 10/1966 | Weckler et al. | 8/493 |
| 4,246,221 | 1/1981 | McCorsley, III | 264/203 |
| 4,400,504 | 8/1983 | Harms et al. | 544/76 |
| 4,563,189 | 1/1986 | Lewis | 8/493 |
| 5,571,444 | 11/1996 | Fisher et al. | 252/8.62 |
| 5,847,090 | 12/1998 | Kunimi et al. | 534/605 |
| 5,851,240 | 12/1998 | Kanzig et al. | 8/541 |
| 5,858,026 | 1/1999 | Kim et al. | 8/566 |

FOREIGN PATENT DOCUMENTS

| | | |
|---|---|---|
| 0118983 | 9/1984 | European Pat. Off. . |
| 0175225 | 3/1986 | European Pat. Off. . |
| 0538977 | 4/1993 | European Pat. Off. . |
| 3740650 | 12/1987 | Germany . |
| 1166741 | 10/1969 | United Kingdom . |
| 9207124 | 4/1992 | WIPO . |
| 9409191 | 4/1994 | WIPO . |
| 9424343 | 10/1994 | WIPO . |

OTHER PUBLICATIONS

Ullmann's Encyclopedia of Industrial Chemistry, Fifth, Completely Revised Edition, vol. A22, pp. 652–654.

Ullmann's Encyklopädie der technischen Chemie, 4$^{th}$ Edition, vol. 20, pp. 114–117 (English translation not available.

Presentation by S. Mortimer at the CELLUCON Conference, Lund, Sweden, 1993, "72 Spinning of Fibres through the N–methylmorpholine–N–oxide process".

*Primary Examiner*—Yogendra Gupta
*Assistant Examiner*—Christine E. Ingersoll
*Attorney, Agent, or Firm*—Baker & Botts LLP

[57] ABSTRACT

A process for the treatment of cellulose fibers of the Lyocell type, wherein said fibers are contacted with a textile auxiliary agent, characterized in that as said textile auxiliary agent a compound of the general formula (I)

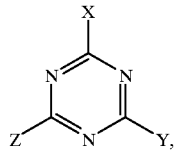

or its alkaline metal salt is employed, wherein X is halogen, alkoxy having 1–4 carbon atoms, amino, alkylamino having 1–4 carbon atoms, hydroxysulphonyl or 1-nicotinyl; Y having the general formula (II)

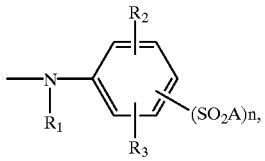

wherein n is the number 1 or 2; $R^1$ is hydrogen, alkyl having 1–4 carbon atoms or phenyl; $R^2$ and $R^3$ are hydrogen, hydroxysulphonyl, hydroxyl, halogen, alkyl having 1–4 carbon atoms or carboxyl; A is vinyl or —$C_2H_4B$, wherein B is a group capable of being cleaved under alkaline conditions; and Z is Y or X.

13 Claims, No Drawings

PROCESS FOR THE TREATMENT OF CELLULOSE FIBRES AND OF ASSEMBLIES MADE FROM THESE FIBRES

"This is a continuation of copending application Ser. No. PCT/AT97/00132 filed Jun. 19, 1997."

The invention is concerned with a process for the treatment of cellulose fibres and of assemblies made from these fibres, in which process the fibres or the fibre assemblies are contacted with a textile auxiliary agent to improve the properties of the fibres. The invention is further concerned with new fibre assemblies such as yarns and plane textile assemblies obtainable according to this process.

BACKGROUND OF THE INVENTION

As an alternative to the viscose process, in recent years there has been described a number of processes wherein cellulose, without forming a derivative, is dissolved in an organic solvent, a combination of an organic solvent and an inorganic salt, or in aqueous saline solutions. Cellulose fibres made from such solutions have received by BISFA (The International Bureau for the Standardisation of man made Fibres) the generic name Lyocell. As Lyocell, BISFA defines a cellulose fibre obtained by a spinning process from an organic solvent. By "organic solvent", BISFA understands a mixture of an organic chemical and water. "Solvent-spinning" means dissolving and spinning without derivatisation.

So far, however, only one process for the production of a cellulose fibre of the Lyocell type has achieved industrial-scale realization. In this process, a tertiary amine-oxide, particularly N-methylmorpholine-N-oxide (NMMO) is used as a solvent. Such a process is described e.g. in U.S. Pat. No. 4,246,221 and provides fibres having a high tensile strength, a high wet-modulus and a high loop strength.

However, the usefulness of plane assemblies such as fabrics produced from the above fibres is significantly restricted by the pronounced tendency of these fibres to fibrillate when wet. Fibrillation means breaking off of the wet fibre in longitudinal direction at mechanical stress, so that the fibre gets hairy, furry. A fabric made from these fibres and dyed significantly loses colour intensity as it is washed several times. Additionally, light stripes are formed at abrasion and crease edges. The reason for fibrillation may be that the fibres consist of fibrils arranged in fibre direction and that there is only little crosslinking between these.

Moreover, stripes may also form when rope-shaped fibre assemblies are dyed. In plane textile assemblies, small knots may form through friction in dry condition, a property known as "pilling".

WO 92/07124 describes a process for the production of a fibre having a reduced tendency to fibrillation, according to which the freshly spun, i.e. not yet dried fibre is treated with a cationic polymer. As such a polymer, a polymer having imidazole and azetidine groups is indicated. Additionally, a treatment with an emulsifiable polymer, such as polyethylene or polyvinylacetate, or a crosslinking with glyoxal may be carried out.

In a lecture held by S. Mortimer at the CELLUCON conference 1993 in Lund, Sweden, it was mentioned that the tendency to fibrillation rises as drawing is increased.

EP-A-0 538 977 and WO 94/09191 describe a process of the type initially mentioned, wherein fibres of the Lyocell type are contacted with a textile auxiliary agent to reduce their tendency to fibrillation.

WO 94/24343 describes a process for the production of cellulose fibres having a reduced tendency to fibrillation, in which process a solution of cellulose in a tertiary amine-oxide is spun into fibres and the freshly spun fibres are contacted with a textile auxiliary agent carrying at least two reactive groups and are washed with an aqueous buffer, not using glyoxal as a textile auxiliary agent. According to this known process, the freshly spun fibres are best contacted with the textile auxiliary agent in an alkaline medium.

It is further known that fibre assemblies made from fibres of the Lyocell type can be crosslinked with methylol compounds to produce wash-resistant wovens and knit fabric. It has been shown however that when these compounds are used it is not possible to prevent the formation of abrasion edges during dyeing. To prevent these, crosslinking would have to be carried out before dyeing or at latest during dyeing. However, methylol compounds as well as the other conventional high-grade finishing agents are hardly appropriate for that purpose. Another drawback of the methylol compounds is the formation of formaldehyde, implying pollution at the workplace.

SUMMARY OF THE INVENTION

It is the purpose of the invention to provide a process for the treatment of cellulose fibres of the Lyocell type and of assemblies made from these fibres which may be carried out in an easy way and which allows the treated fibres to have a reduced tendency to fibrillation and the treated fibre assemblies or the fibre assemblies containing treated fibres to have improved abrasion and pilling values.

The process according to the invention for the treatment of cellulose fibres wherein the fibres are contacted with a textile auxiliary agent is characterized in that as the textile auxiliary agent a compound of the general formula (I)

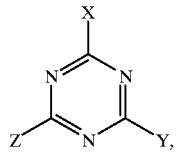

or its alkaline metal salt is employed, wherein X is halogen, alkoxy having 1–4 carbon atoms, amino, alkylamino having 1–4 carbon atoms, hydroxysulphonyl or 1-nicotinyl; Y having the general formula (II)

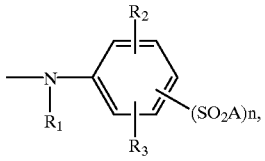

wherein n is an integer of 1 or 2; $R_1$ is hydrogen, alkyl having 1–4 carbon atoms or phenyl; $R_2$ and $R_3$ are hydrogen, hydroxysulphonyl, hydroxyl, halogen, alkyl having 1–4 carbon atoms or carboxyl; A is vinyl or —$C_2H_4B$, wherein B is a group capable of being cleaved under alkaline conditions; and Z is Y or X.

Production of the compounds indicated above is known from DE-OS 37 40 650 and from Ullmann's Encyclopedia of Industrial Chemistry, 5. edition, vol. A22, p. 652–654 and from Ullmanns Encyclopädie der technischen Chemie, 4. edition, vol. 20, p. 114–117. Some of these compounds are described in DE-OS 37 40 650 as fibre-reactive, non-chromophore amines.

An appropriate embodiment of the process according to the invention is characterized in that fibres of the Lyocell type are contacted with the textile auxiliary agent used according to the invention in an alkaline medium. Crosslinking agents active in an alkaline medium may be employed during the reactive dyeing.

DETAILED DESCRIPTION OF THE PREFERRED EMBODIMENTS

A preferred embodiment of the process according to the invention consists in that as a textile auxiliary agent the compound (III)

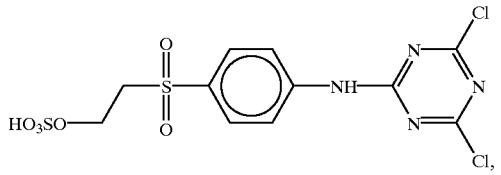

or its alkaline metal salt is employed. A procedure for the production of this compound is known from Example 9 of DE-OS-37 40 650.

Further preferred embodiments of the process according to the invention consist in that the fibres are employed in a non-dyed state or that the treatment is carried out while the fibres are simultaneously being dyed, or that the fibres are present as fibre assemblies.

The present invention is further concerned with the use of a compound of the general formula (I)

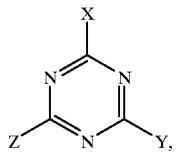

wherein X, Y and Z have the meaning indicated above or its alkaline metal salt as a textile auxiliary agent for the treatment of fibres of the Lyocell type or for the treatment of assemblies of fibres of the Lyocell type, a yarn or a plane textile assembly being best used as the fibre assembly. As plane textile assemblies, a woven or a knit fabric are particularly appropriate.

The invention is further concerned with the use of the above compound of the general formula (I) to improve the pilling behaviour, to reduce pill formation and to improve the white abrasion be haviour of the plan e textile assembly.

The present invention is further concerned with fibres of the Lyocell type obtainable according to the process according to the invention and yarns and fibre assemblies containing these fibres.

The treatment according to the invention with the compounds indicated above may be carried out before, during or after dyeing and on the fibre, the yarn and the fibre assembly. A preferred embodiment of the invention wherein the above compound of formula (III) is used is explained in more detail by means of the following Examples. All percentages indicated are % by mass.

1) Production of the Cellulose Fibres

According to the process described in EP-A -0 356 419 and WO 93/19230, cellulose fibres of the Lyocell type were produced. These fibres were further processed into a textile in a known manner. The treatment of the fibres is carried out using the compound of formula (III). In the following, this compound is referred to as "substance I".

2) General Dyeing Procedure

The textile is impregnated at a liquor ratio of 1:20 with 6% reactive dye (Remazol Brilliant Blue BB or Remazol Black B) for 10 minutes at 40° C. The dye bath contains 0.3 ml/l of an anti-crease agent (such as Biavin 109). Afterwards, 50 g/l of $Na_2SO_4$ are added in portions within 20 minutes. Thereafter, 5 g/l of $Na_2CO_3$ are added and it is heated to 60° C. After 15 more minutes, 0.25 ml/l of NaOH are added and it is dyed for further 20 minutes. Thereafter, it is rinsed warm, adjusted to a pH of 5.5 by means of acetic acid and rinsed cold, boiling and finally cold again. Unless otherwise indicated in the following, the textiles are finished with 1 ml/l of softener (Basosoft, Avivan GSA) at 60° C.

EXAMPLE 1

4 m of Single Jersey (100% Lyocell, 1.7 dtex, Nm 50) are treated with 1 g/l of a detergent (Kiralon Jet), 2 g/l of $Na_2CO_3$ for 10 minutes at 30° C. (liquor ratio 1:15). Afterwards, 3% (based on the product weight) of Substance I are added. After 10 further minutes, 20 g/l of $NA_2SO_4$ are added and the temperature is raised to 40° C. After 10 further minutes, the $Na_2CO_3$ concentration is raised to a total of 5 g/l and it is heated to 80° C. After 15 minutes, it is rinsed cold and warm and dyed according to the above rule.

EXAMPLE 2

4 m of Single Jersey (100% Lyocell, 1.7 dtex, Nm 50) are treated with 1 g/l of a detergent (Kiralon Jet), 2 g/l of $Na_2CO_3$ for 10 minutes at 30° C. (liquor ratio 1:15) Afterwards, 3% (based on the product weight) of Substance I are added. After 10 further minutes, the temperature is raised to 40° C. After 10 further minutes, the $Na_2CO_3$ concentration is raised to a total of 5 g/l and it is heated to 80° C. After 15 minutes, it is rinsed cold and warm and dyed according to the above rule.

EXAMPLE 3 (Comparative Example)

4 m of Single Jersey (100% Lyocell, 1.7 dtex, Nm 50) are treated with 1 g/l of a detergent (Kiralon Jet), 2 g/l of $Na_2CO_3$ for 10 minutes at 30° C. (liquor ratio 1:15) After 10 further minutes, the temperature is raised to 80° C. After 30 minutes, it is rinsed cold and warm and dyed according to the above rule.

Result of the Examples 1 to 3

Washing test:

The samples obtained in Examples 1 to 3 were washed 10 times at 60° C. after dyeing and dried in the tumbler (according to DIN 53920 and ISO 6330, DIN 26330 without prewash).

Evaluation regarding pill formation and white abrasion was carried out after the fifth and after the tenth washing. Pill formation during washing shows the behaviour in wet condition.

Degrees are given according to EMPA photographic models and extend from 1 (=present in significant amounts; i.e. bad) to 5 (not present; i.e. good), being summed up in the following Table:

TABLE 1

| | Ex. 1 | Ex. 2 | Ex. 3 |
|---|---|---|---|
| Pill formation after 5 washings | 4.5 | 4.5 | 4.5 |
| Pill formation after 10 washings | 3.5 | 3.0 | 1.5 |
| White abrasion after 5 washings | 5.0 | 5.0 | 3.0 |
| White abrasion after 10 washings | 5.0 | 4.0 | 2.0 |

From Table 1 it can be seen that pill formation as well as white abrasion is significantly reduced in the samples treated with Substance I after 5 and 10 washings.

EXAMPLE 4

This Example is analogous to Example 1, except that instead of Single Jersey the following fabric is used: 100% Lyocell, 1.7 dtex, twill, yarn count of weft and warp Nm 50, length 150 cm and width 30 cm.

EXAMPLE 5

This Example is analogous to Example 2, except that instead of Single Jersey the following fabric is used: 100% Lyocell, 1.7 dtex, twill, yarn count of weft and warp Nm 50, length 150 cm and width 30 cm.

EXAMPLE 6 (Comparative Example)

This Example is analogous to Example 3, except that instead of Single Jersey the following fabric is used: 100% Lyocell, 1.7 dtex, twill, yarn count of weft and warp Nm 50, length 150 cm and width 30 cm.

The fabrics obtained in Examples 4, 5 and 6 are sewn together and dyed in the laboratory jet (Mathis, nozzle 40 mm, 1 rotation/minute) according to the above dyeing procedure.

The fabric of Example 6 shows significant brightenings due to abrasion edges, while the fabrics of Examples 4 and 5 are stripe-free.

Also regarding pill formation and white abrasion, the fabrics of Examples 4 and 5 clearly show better values than the piece of fabric of Example 6.

EXAMPLE 7

4 kg of yarn (100% Lyocell, 1.7 dtex, Nm 50) are treated with 2 g/l of detergent (Kiralon OLB), 2 g/l of $Na_2CO_3$ for 30 minutes at 95° C. in a yarn dyeing apparatus (alternate pumping: 4 minutes from the inside to the outside; 6 minutes from the outside to the inside). Afterwards it is rinsed hot and cold. During the last rinsing bath, the pH is adjusted to 6.0 by means of acetic acid.

Thereafter, it is impregnated with 10% of substance I (based on the fabric weight) for 15 minutes at 30° C. Then 6% of reactive dye (Remazol Black B) are added. It is heated to 50° C. and within 55 minutes 50 g/l of $Na_2SO_4$ are added in portions. Afterwards 2.5 g/l of $Na_2CO_3$ are added and it is heated to 60° C. After 15 more minutes, further 7.5 g/l of $Na_2CO_3$ are added. After 15 minutes 0.25 ml/l of NaOH are added, and it is dyed for 30 more minutes. Thereafter it is rinsed warm, the pH is adjusted to 5.5 by means of acetic acid, and it is rinsed (cold, boiling and finally again cold).

Unless otherwise indicated in the following, the yarns are finished using 1 ml/l of softener (Basosoft, Avivan GSA) at 60° C. and waxed.

From the yarn thus obtained, a Single Jersey and socks are knit.

EXAMPLE 8 (Comparative Example)

4 kg of yarn (100% Lyocell, 1.7 dtex, Nm 50) are treated with 2 g/l of detergent (Kiralon OLB), 2 g/l of $Na_2CO_3$ for 30 minutes at 95° C. in a yarn dyeing apparatus (alternate pumping: 4 minutes from the inside to the outside; 6 minutes from the outside to the inside). Afterwards it is rinsed hot and cold. During the last rinsing bath, the pH is adjusted to 6.0 by means of acetic acid.

Thereafter, it is impregnated using 6% of reactive dye (Remazol Black B) for 15 minutes at 30° C. It is heated to 50° C. and within 55 minutes 50 g/l of $Na_2SO_4$ are added in portions. Afterwards 2.5 g/l of $Na_2CO_3$ are added and it is heated to 60° C. After 15 more minutes, further 7.5 g/l of $Na_2CO_3$ are added. After 15 minutes 0.25 ml/l of NaOH are added, and it is dyed for 30 more minutes. Thereafter it is rinsed warm, the pH is adjusted to 5.5 by means of acetic acid, and it is rinsed (cold, boiling and finally again cold).

Unless otherwise indicated in the following, the yarns are finished using 1 ml/l of softener (Basosoft, Avivan GSA) at 60° C. and waxed.

From the yarn thus obtained, socks are knit.

EXAMPLE 9

The Single Jersey of Example 7 and a Single Jersey made from the same, not treated yarn are dyed together in the laboratory jet (Mathis, nozzle 40 mm, 1 rotation/minute) according to the above dyeing procedure, thus fabrics 9a and 9b respectively being obtained.

The dyed Single Jersey 9a shows no stripes or abrasion spots. On the contrary, in Single Jersey 9b abrasion edges and also a greying can be clearly seen.

The socks are repeatedly washed at 40° C. Each drying is carried out in the tumbler. Already after 5 washing cycles, the socks made from the yarn of Example 8 show a significant greying. On the contrary, the socks made from the yarn of Example 7 do not show any greying nor abrasion edges.

TABLE 2

| | Example 7 | Example 8 |
|---|---|---|
| Pill formation after 5 washings | 4.5 | 2.0 |
| White abrasion after 5 washings | 5.0 | 1.0 |

Even after 20 washings, the socks of Example 7 show a pill formation of 4.5 and a white abrasion of 5.

Pilling Test

The pilling test is carried out according to SN 198525 in dry condition.

Evaluation is carried out visually according to the Standard by means of comparative images. Degree 5 means low pilling, while degree 1 means extreme pilling. In the subsequent Table 3, "pill 125", "pill 500" and "pill 2000" means pilling after 125, 500 and 2000 cycles respectively.

TABLE 3

| | Pill 125 | Pill 500 | Pill 2000 |
|---|---|---|---|
| Example 9a | 4.5 | 4.0 | 4.0 |
| Example 9b | 3.5 | 2.5 | 1.0 |

EXAMPLE 10 (Comparison with Triacryloylhexahydrotriazine (TAHT))

A Lyocell fabric dyed with reactive dyes (twill, 1.7 dtex, Nm 50) is impregnated on the padding machine using a liquor (liquor pickup: 80%) containing 10 g/l of crosslinking agent and 3 ml of surfactant (Leonil SR). Then the fabric is dried at 60° C. and impregnated again using a liquor (liquor pickup: 80%) containing 10 g/l of crosslinking agent (Substance I or TAHT), 3 ml of surfactant (Leonil SR), 10 g/l of softener (Sandolub NV), 10 g/l of $Na_2CO_3$ and 1 ml/l of NaOH.

Thereafter, the fabric is left to rest welded into a foil for 16 hours at 70° C. Afterwards it is rinsed (cold, warm and finally boiling), acetic acid is added and it is dried at 60° C. The result regarding white abrasion is indicated in Table 4.

TABLE 4

| | White abrasion | |
|---|---|---|
| Crosslinking agent | after 3 washings | after 5 washings |
| TAHT | 1.0 | 1.0 |
| Substance I | 3.0 | 2.0 |

I claim:

1. A process for the treatment of Lyocell cellulose fibres comprising the steps of:

contacting said fibres with a textile auxiliary agent said textile auxiliary agent comprising a compound selected from the group consisting of a compound of the general formula (I)

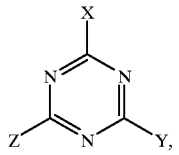

and alkaline metal salts thereof wherein x is halogen, alkoxy having 1–4 carbon atoms, amino, alkylamino having 1–4 carbon atoms, hydroxysulphonyl or 1-nicotinyl;

y having the general formula (II)

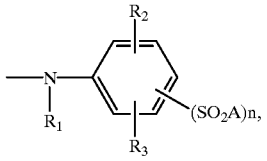

wherein n is an integer of 1 or 2; $R_1$, is a hydrogen, alkyl having 1–4 carbon atoms or phenyl; $R_2$ and $R_3$ are hydrogen, hydroxysulphonyl, hydroxyl, halogen, alkyl having 1–4 carbon atoms or carboxyl; A is vinyl or $C_2H_4B$, wherein B is a group capable of being cleaved under alkaline conditions; and Z is selected from the group of Y and X.

2. A process according to claim 1 wherein said textile auxiliary agent is selected from the group consisting of the compound (III)

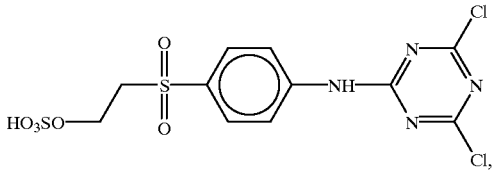

and alkaline metal salts thereof.

3. A process according to any one of claim 1 or claim 2 wherein said fibres are in a non-dyed state.

4. A process according to any one of claim 1 or claim 2 comprising simultaneously dying said fibres.

5. A process according to any one of claim 1 or claim 2 wherein said fibres are present as fibre assemblies.

6. A process according to claim 5 wherein said fibre assemblies are selected from the group consisting of a yarn and a plane textile assembly.

7. A process according to claim 6 wherein said plane textile assembly is selected from the group consisting of a woven fabric and a knit fabric.

8. A process according to claim 3 wherein said fibres are present as fibre assemblies.

9. A process according to claim 4 wherein said fibres are present as fibre assemblies.

10. A process according to claim 8 wherein said fibre assemblies are selected from the group consisting of a yarn and a plane textile assembly.

11. A process according to claim 9 wherein said fibre assemblies are selected from the group consisting of a yarn and a plane textile assembly.

12. A process according to claim 10 wherein said plane textile assembly is selected from the group consisting of a woven fabric and a knit fabric.

13. A process according to claim 11 wherein said plane textile assembly is selected from the group consisting of a woven fabric and a knit fabric.

* * * * *

UNITED STATES PATENT AND TRADEMARK OFFICE

CERTIFICATE OF CORRECTION

PATENT NO. : 6,022,378
DATED : February 8, 2000
INVENTOR(S) : Markus Eibl

It is certified that error appears in the above-identified patent and that said Letters Patent is hereby corrected as shown below:

Title page,
Item [56], References Cited, OTHER PUBLICATIONS,under Ullman's (second occurrence), "available." should read -- available). --

Column 7,
Line 41, "y" should read -- Y --

Column 1,
Line 16, "has" should read -- have --

Column 3,
Line 55, "be haviour" should read -- behavior --; and "plan e" should read -- plane --

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*